US010753171B2

(12) United States Patent
Kellner

(10) Patent No.: US 10,753,171 B2
(45) Date of Patent: Aug. 25, 2020

(54) ANTI-EXTRUSION ASSEMBLY FOR A DOWNHOLE TOOL

(71) Applicant: TEAM OIL TOOLS, LP, The Woodlands, TX (US)

(72) Inventor: Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 30 days.

(21) Appl. No.: 16/090,956

(22) PCT Filed: Apr. 10, 2017

(86) PCT No.: PCT/US2017/026803
§ 371 (c)(1),
(2) Date: Oct. 3, 2018

(87) PCT Pub. No.: WO2017/177227
PCT Pub. Date: Oct. 12, 2017

(65) Prior Publication Data

US 2019/0112891 A1 Apr. 18, 2019

Related U.S. Application Data

(60) Provisional application No. 62/320,361, filed on Apr. 8, 2016.

(51) Int. Cl.
*E21B 33/12* (2006.01)
*E21B 33/127* (2006.01)
(Continued)

(52) U.S. Cl.
CPC ..... *E21B 33/1216* (2013.01); *E21B 33/127* (2013.01); *E21B 33/128* (2013.01); *E21B 33/129* (2013.01); *E21B 33/134* (2013.01)

(58) Field of Classification Search
CPC ..... E21B 33/1216
See application file for complete search history.

(56) References Cited

U.S. PATENT DOCUMENTS

2002/0043368 A1 4/2002 Bell et al.
2008/0060821 A1 3/2008 Smith et al.
(Continued)

OTHER PUBLICATIONS

Tae Wook Park (Authorized Office), International Search Report and Written Opinion dated Jul. 17, 2017, PCT Application No. PCT/US2017/026803, filed Apr. 10, 2017, pp. 1-16.
(Continued)

*Primary Examiner* — Kristyn A Hall
(74) *Attorney, Agent, or Firm* — MH2 Technology Law Group LLP

(57) ABSTRACT

A downhole tool includes a sealing element configured to expand radially outwards to form a seal with a surrounding tubular, a cone defining a tapered surface, and a slips assembly comprising a plurality of slips. The slips assembly is receivable at least partially around the cone, such that moving the cone in an axial direction with respect to the slips assembly causes the plurality of slips to separate circumferentially apart. The tool also includes a backup member positionable at least partially around the tapered surface of the cone and positioned adjacent to the slips assembly. The backup member is configured to break as the cone is moved toward the plurality of slips, to prevent the sealing element from extruding between circumferentially-adjacent slips of the plurality of slips.

21 Claims, 12 Drawing Sheets

(51) Int. Cl.

| | |
|---|---|
| ***E21B 33/128*** | (2006.01) |
| ***E21B 33/129*** | (2006.01) |
| *E21B 33/134* | (2006.01) |

(56) References Cited

U.S. PATENT DOCUMENTS

| | | | | |
|---|---|---|---|---|
| 2009/0255690 | A1 | 10/2009 | Conner et al. | |
| 2012/0217025 | A1 | 8/2012 | Shkurti et al. | |
| 2013/0306330 | A1* | 11/2013 | Bishop ..... | E21B 33/1216 166/387 |
| 2014/0262344 | A1 | 9/2014 | Standridge | |

OTHER PUBLICATIONS

Xiaofan Tang (Authorized Officer), International Preliminary Report on Patentability dated Oct. 18, 2018, PCT Application No. PCT/US2017/026803, filed Apr. 10, 2017, pp. 1-13.

* cited by examiner

ANTI-EXTRUSION ASSEMBLY FOR A DOWNHOLE TOOL

CROSS REFERENCE TO RELATED APPLICATIONS

This application is a U.S. National Stage Application of PCT/US2017/026803, filed Apr. 10, 2017, which claims priority to U.S. Provisional Patent Application having Ser. No. 62/320,361, which was filed on Apr. 8, 2016, and are incorporated herein by reference in their entirety.

BACKGROUND

Packers, bridge plugs, frac plugs, and other downhole tools may be deployed into a wellbore and set in place. Generally, such setting is accomplished using a system of slips and seals received around a mandrel. A setting tool is used to axially compress the slips and sealing elements, and thereby radially expand them. The slips, which often have teeth, grit, buttons, or other marking structures, ride up the inclined surface of a cone during such compression, and are thus forced outwards into engagement with a surrounding tubular (e.g., a casing or the wellbore wall itself). This causes the slips to bite into the surrounding tubular, thereby holding the downhole tool in place. The seal is simultaneously expanded by such axial compression into engagement with the surrounding tubular, so as to isolate fluid communication axially across the tool.

The seals are typically elastomeric, and have a tendency to extrude during setting and/or when a large pressure differential across the seals is present, such as during hydraulic fracturing. In particular, the seals may extrude through a gap between circumferentially-adjacent slips, which forms when the slips are expanded radially outwards. To address this tendency, backup members are sometimes positioned axially between the slips and the seals to block these gaps and prevent extrusion.

SUMMARY

Embodiments of the disclosure may provide a downhole tool that includes a sealing element configured to expand radially outwards to form a seal with a surrounding tubular, a cone defining a tapered surface, and a slips assembly comprising a plurality of slips. The slips assembly is receivable at least partially around the cone, such that moving the cone in an axial direction with respect to the slips assembly causes the plurality of slips to separate circumferentially apart. The tool also includes a backup member positionable at least partially around the tapered surface of the cone and positioned adjacent to the slips assembly. The backup member is configured to break as the cone is moved toward the plurality of slips, to prevent the sealing element from extruding between circumferentially-adjacent slips of the plurality of slips.

Embodiments of the disclosure may also provide a method that includes positioning a cone axially adjacent to a sealing element of a downhole tool, positioning a backup member around a tapered surface of the cone, positioning a slips assembly comprising a plurality of slips axially adjacent to at least a portion of the cone, such that the backup member is axially between the sealing element and the slips assembly, and expanding the sealing element, the backup member, and the slips assembly, at least partially by moving the cone relative to the backup member and the slips assembly. The backup member is configured to prevent the sealing element from extruding through gaps defined between circumferentially-adjacent slips of the plurality of slips of the slips assembly.

Embodiments of the disclosure may also provide a downhole tool that includes a sealing element that is expandable radially outwards to form a seal with a surrounding tubular, a cone defining a tapered surface, and a plurality of slips receivable at least partially around the cone. The plurality of slips are configured to separate circumferentially apart by moving the cone in an axial direction toward the plurality of slips. The tool also includes at least one slips ring positioned at least partially around the tapered surface of the cone and axially between the sealing element and the plurality of slips. The at least one slips ring is configured to break as the cone is moved toward the plurality of slips, and the at least one slips ring is configured to prevent the sealing element from extruding between circumferentially-adjacent slips of the plurality of slips.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
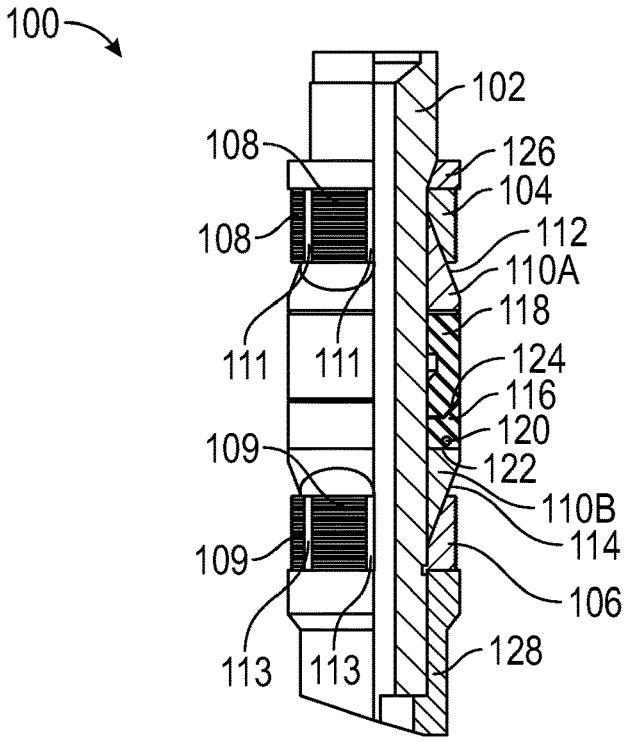
FIG. 1 illustrates a side, quarter sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, quarter-sectional view of a downhole tool 100, according to an embodiment. The downhole tool 100 may be a packer, a bridge plug, a frac plug, or the like, without limitation. The downhole tool 100 may include a body 102, which may be hollow, at least partially obstructed, configured to catch a ball, or the like, depending on the application. In some embodiments, the body 102 may be cylindrical, as shown. The body 102 may include one single member, or several members attached together, e.g., end-on-end.

Several components may be positioned around, or at least partially around, the body 102, which may be used to set and/or seal the downhole tool 100 in the well. For example, the downhole tool 100 may include one or more slips assemblies (two are shown: 104, 106). The slips assembly 104, 106 may include a plurality of arcuate slips segments 108, 109, respectively. Gaps 111, 113 may be present between the arcuate slips segments 108, 109, and gaps 111, 113 may increase in size during radial expansion slips assemblies 104, 106 during setting.

One or more cones (two are shown: 110A, 110B) may be positioned axially adjacent to the slips assemblies 104, 106, at least prior to setting the tool 100. The cones 110A, 110B may include tapered outer surfaces 112, 114, respectively, and may be positioned radially between at least a portion of the slips assemblies 104, 106 and the body 102, such that the tapered outer surfaces 112, 114 engage an inner surface of the slips assemblies 104, 106, as shown.

The downhole tool 100 may further include one or more sealing elements. In the illustrated embodiment, the downhole tool 100 includes a first sealing element 116 and a second sealing element 118. In some embodiments, the downhole tool 100 may include a third sealing element, e.g., opposite to the first sealing element 116, such that the second sealing element 118 is disposed therebetween. In still other embodiments, a single sealing element (e.g., the second sealing element 118) may be employed.

The first sealing element 116 may include an anti-extrusion member 120. In an embodiment, the anti-extrusion member 120 may be provided by a helical member, such as a spring. The term "helical" should be broadly interpreted to include any wound geometry, and not solely those structures that meet the geometrical definition of a helix, unless otherwise specified herein. For example, in a helical embodiment, the anti-extrusion member 120 may include oval-shaped windings, polygonal windings, etc. The anti-extrusion member 120 may be configured to expand radially, as the first sealing element 116 expands during setting, as will be described in greater detail below.

Further, the first sealing element 116 has first and second axial ends 122, 124. The first axial end 122 faces the proximal (e.g., adjacent) slips assembly 106, while the second axial end 124 is opposite to the first axial end 122 and faces away from the proximal slips assembly 106 and towards the second sealing element 118. In some embodiments, the second end 124 is positioned at least partially around the second sealing element 118, so as to at least partially overlap the second sealing element 118. This overlapping may serve to limit or prevent extrusion of the second sealing element 118 past the first sealing element 116 during setting and/or during use.

The downhole tool 100 may also include a collar 126 and a shoe 128, which may be positioned such that the remainder of the components positioned around the body 102 are axially therebetween. The collar 126 may include a locking mechanism, which may allow the collar 126 to move toward the shoe 128, but prevent movement of the collar 126 in the opposite axial direction. The shoe 128 may be integral with or securely fixed to the body 102. Accordingly, to set the tool 100, the body 102 may be engaged and held in position (or moved upwards) relative to a sleeve that pushes against the collar 126. This may cause the axial compression of the outer components between the collar 126 and the shoe 128. As such, the slips assemblies 104, 106 may slide up the tapered surfaces 112, 114 of the cones 110A, 110B, and be driven radially outward by such engagement. Further, the sealing elements 116, 118 may be axially compressed and expanded radially outwards.

The anti-extrusion member 120 may expand along with the first sealing element 116 during setting, and may resist extrusion into the enlarged gaps 113 during and after setting. Accordingly, the first sealing element 116 material around the anti-extrusion member 120 may likewise resist extrusion, since the embedded anti-extrusion member 120 may be prevented from moving into the gaps 113.

In some embodiments, the anti-extrusion member 120 may be made from a composite material, which may facilitate drilling or milling out the tool 100 for removal from the well. Such composite materials may include carbon-fiber reinforced materials, such as phenolics, glass, and the like. In another embodiment, the anti-extrusion member 120 may be made from a metallic material (e.g., a metal or an alloy of two or more metals).

Figure 2A:
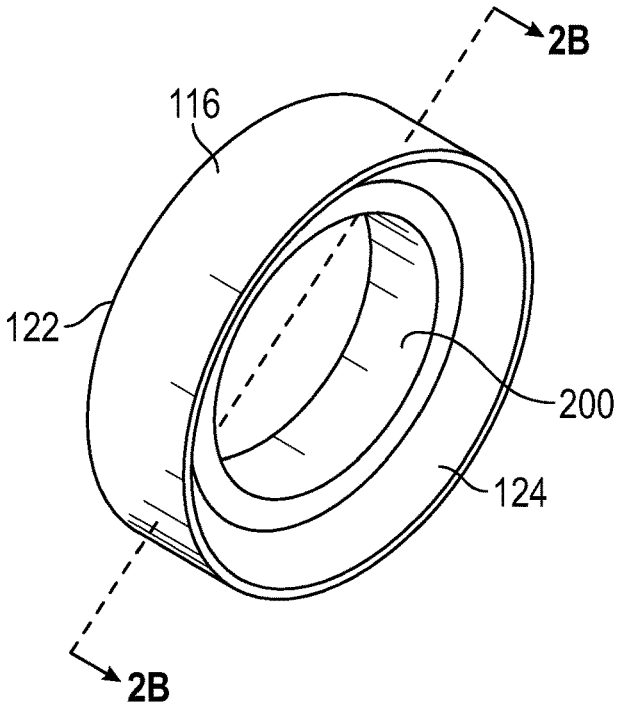
FIG. 2A illustrates a perspective view of a sealing element of the downhole tool, according to an embodiment.
Figure 2B:
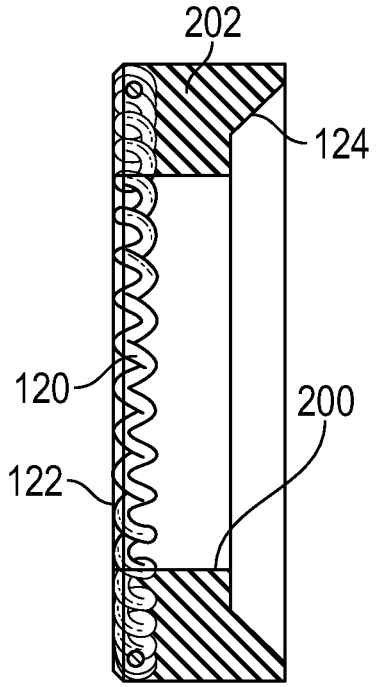
FIG. 2B illustrates a side, cross-sectional view of the sealing element, as indicated along line 2B-2B of FIG. 2A, according to an embodiment.
Figure 2C:
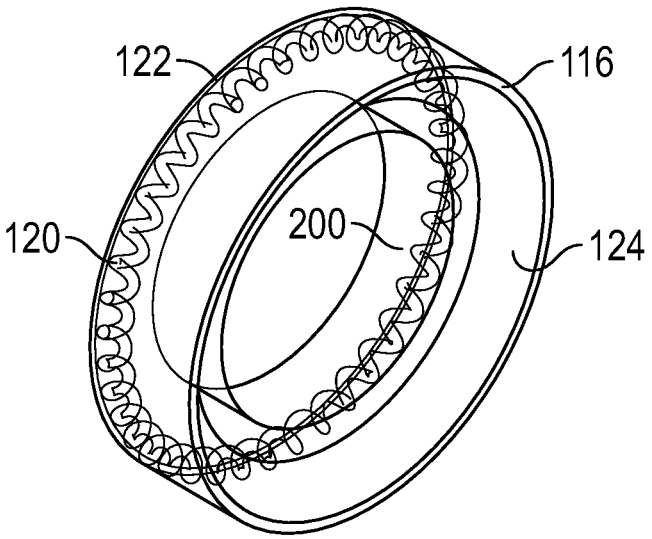
FIG. 2C illustrates a perspective view of the sealing element, with the main body thereof shown transparent for purposes of illustration, according to an embodiment.

FIG. 2A illustrates a perspective view of the first sealing element 116, according to an embodiment. FIG. 2B illustrates a side, sectional view of the first sealing element 116, along line 2B-2B as shown in FIG. 2A, and FIG. 2C illustrates a transparent view of the first sealing element 116, illustrating an embodiment of the anti-extrusion member 120 embedded therein. Beginning with FIG. 2A, as shown, the first sealing element 116 includes the first and second ends 122, 124. The second end 124, which may be configured to overlap the second sealing element 118 (see FIG. 1), may be tapered, as shown. Further, the sealing element 116 may define a bore 200 therethrough, which may receive the body 102 therethrough.

In FIG. 2B, an embodiment of the anti-extrusion member 120 is visible. The anti-extrusion member 120 is not visible in FIG. 2A, since, as may be appreciated from FIG. 2B, it is embedded entirely within a main body 202 of the first sealing element 116. In FIG. 2C, the anti-extrusion member 120 is again visible, as the main body 202 is shown as transparent for purposes of illustration. In other embodiments, however, the anti-extrusion member 120 may protrude axially from the first end 122 or radially inward or outward, such that the anti-extrusion member 120 is partially outside of the first sealing element 116. Further, as best seen in FIG. 2C, in some embodiments, the anti-extrusion member 120 may be positioned near the radially-outer extent of the first sealing element 116, which may be the area most prone to extrusion.

Figure 3:
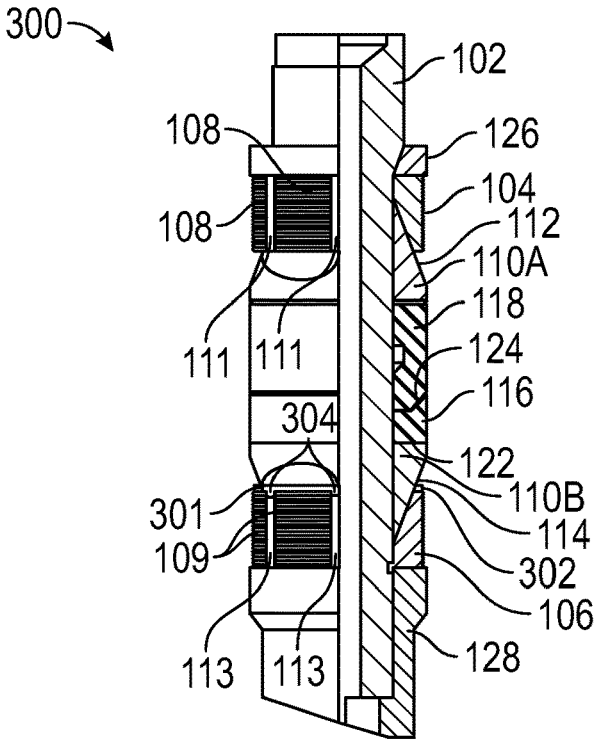
FIG. 3 illustrates a side, quarter sectional view of another downhole tool, according to an embodiment.

FIG. 3 illustrates a side, quarter-sectional view of another downhole tool 300, according to an embodiment. The downhole tool 300 may include several of the same or similar components as the downhole tool 100, and such like components are given the same numbers in the Figures and a duplicative description thereof is omitted.

The downhole tool 300 may include a backup member, such as a slips ring 301. As shown, the slips ring 301 may be positioned axially between the first sealing element 116 and the lower slips assembly 106; however, this is merely an example. In some embodiments, a second slips ring could be positioned adjacent to the upper slips assembly 104, in addition to or instead of the slips ring 301. In an embodiment, the slips ring 301 may be made at least partially from a composite material.

In the illustrated embodiment, the slips assembly 104 includes a distal end 302, which may be the end of the slips assembly 104 that faces the first sealing element 116, and, e.g., extends the farthest radially outwards by sliding along the cone 110B. The slips ring 301 may engage the distal end 302 of the slips assembly 104. Further, the slips ring 301 may include tabs 304, which may extend axially into the gaps 113 between adjacent slip segments 110.

Figure 4:
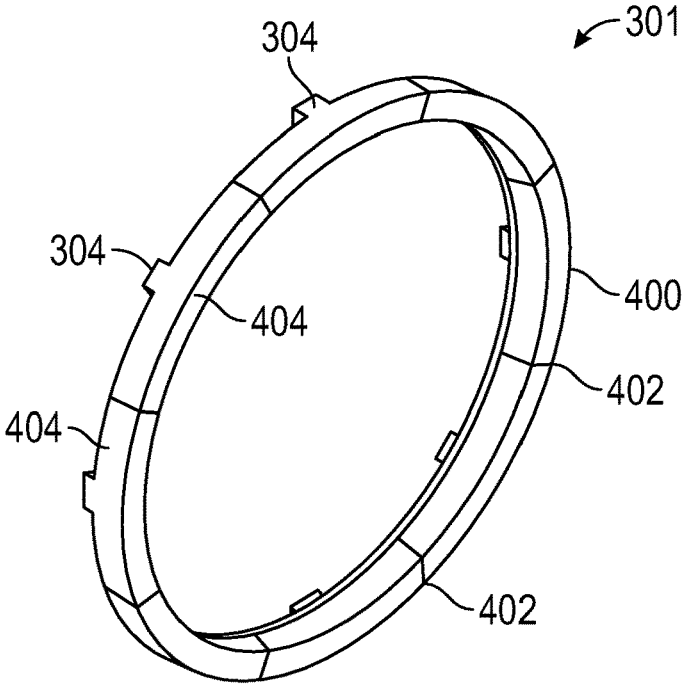
FIG. 4 illustrates a perspective view of a slips ring, according to an embodiment.

FIG. 4 illustrates a perspective view of the slips ring 301, according to an embodiment. As shown, the slips ring 301 includes the tabs 304, which may extend axially from a base 400 of the slips ring 301. In addition, the base 400 may include notches 402, which may define weak points in the base 400, where the base 400 may be configured to fracture or break apart during setting, resulting in arcuate ring segments 404 being separated apart, as will be described in greater detail below. The notches 402 may not extend entirely through the base 400, such that the slips ring 301 may remain generally rigid prior to setting. Further, any number of notches 402 may be provided, and thus any resulting number of segments 404 may be employed.

Figure 5A:
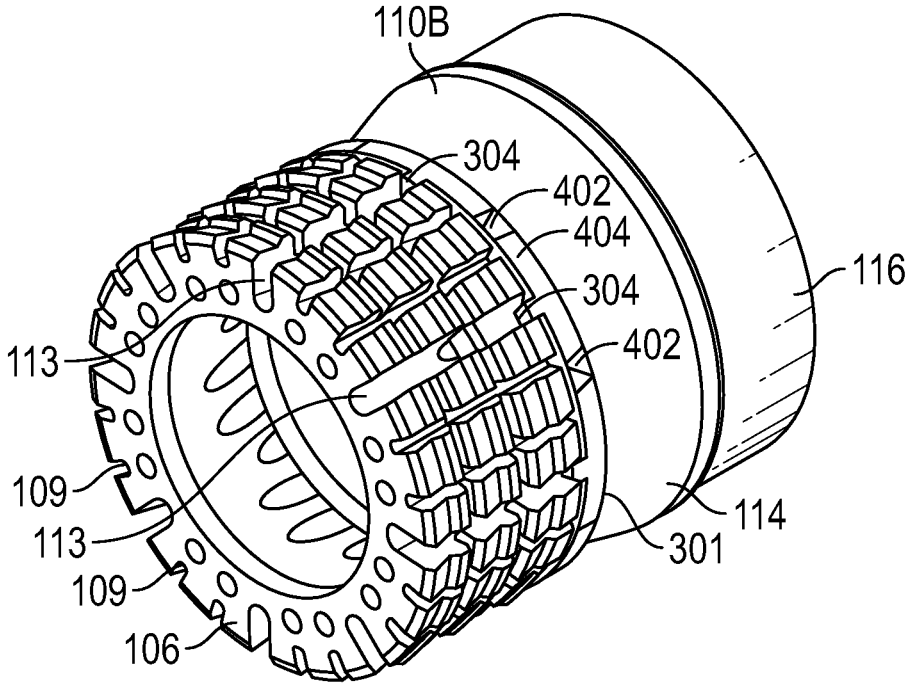
FIGS. 5A and 5B illustrate perspective views of a slips assembly, a cone, the sealing element, and the slips ring, in an unset configuration and an expanded, set configuration, respectively, according to an embodiment.
Figure 5B:
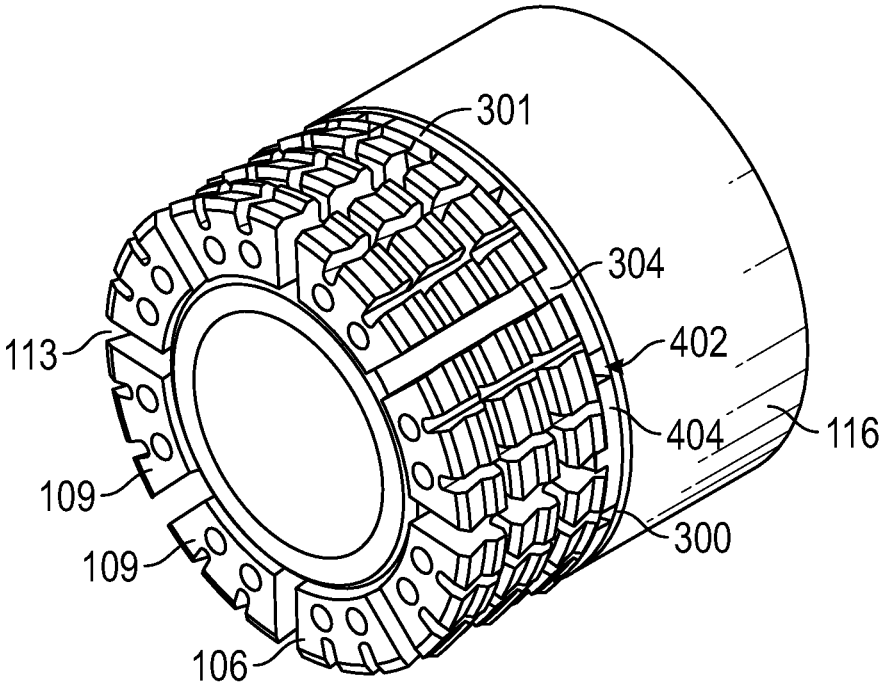

FIGS. 5A and 5B illustrate the interaction of the slips ring 301 with the cone 110B and the slips assembly 106, according to an embodiment. In particular, in FIG. 5A, the slips assembly 106 is shown in an unexpanded, run-in configuration, while in FIG. 5B, the slips assembly 106 is shown in an expanded, set configuration. Further, in FIG. 5A, the slips ring 301 is positioned around the tapered surface 114 of the cone 110B. As can also be seen in FIG. 3, the slips ring 301 slides against the tapered surface 114 of the cone 110B, similar to the slips assembly 106, such that the interaction with the cone 110B breaks the slips ring 301 apart into the segments 404. Further, each of the gaps 113 receives one of the tabs 304 therein. It will be appreciated that, in some embodiments, one or more of the gaps 113 may not receive a tab 304. Additionally, as can be seen in FIG. 5A, the gaps 113 may not extend entirely radially through the slips assembly 106, and the slip segments 110 may initially be coupled together, e.g., integrally formed. In other embodiments, the slip segments 110 may be separate pieces that may initially be held together, e.g., using a band.

Moving to FIG. 5B, the slip assembly 106 is driven up along the cone 110B and expands radially outwards, while the slip segments 109 may break apart as it is moved radially outwards. The first sealing element 116 is also expanded radially outward during this process, as shown.

During this process, the slips ring 301 is also driven along the cone 110B, and fractures into its component segments 404. The tabs 304 may, however, remain in the gaps 113, and eventually the distal end 302 of the slips assembly 106 and the first end 122 of the first sealing element 116 may entrain the slips ring segments 404 therebetween. As such, the slips ring segments 404 may block the first sealing element 116 from extruding through the gaps 113.

In the illustrated example, each segment 404 provides a single tab 304, which extends into one of the gaps 113; however, this is merely one embodiment. Other embodiments may include one segment 404 having two or more tabs 304 and segments 404 including no tabs 304.

Figure 6:
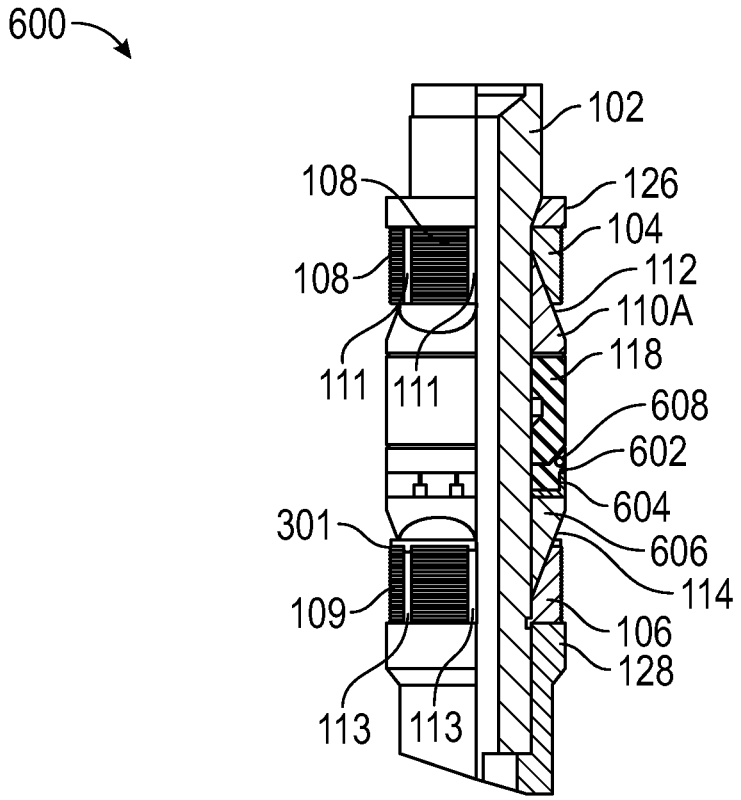
FIG. 6 illustrates a side, quarter sectional view of another downhole tool, according to an embodiment.

FIG. 6 illustrates a side, quarter-sectional view of another downhole tool 600, according to an embodiment. The downhole tool 600 may include several of the same or similar components as the downhole tools 100 and/or 300, and such like components are given the same numbers in the Figures and a duplicative description thereof is omitted.

The downhole tool 600 may include a modified first sealing element 602 and a modified cone 606. For example, the first sealing element 602 may be co-molded with a plurality of backup members 604. The backup members 604 may be positioned axially between the first sealing element 602 and the cone 110B, and at least a portion of the first sealing element 602 may axially overlap at least a portion of the first sealing element 602. The backup members 604 may be formed from a composite material, or another material that is relatively hard in comparison to the elastomeric first sealing element 602. Accordingly, the backup members 604 may be configured to reduce or avoid extrusion of the first sealing element 602 through the gaps 113 in the slips assembly 106.

Figure 7A:
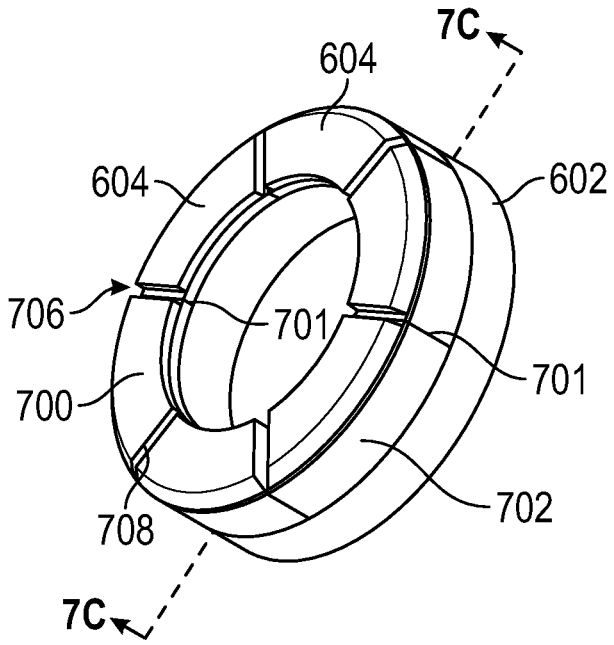
FIG. 7A illustrates a perspective view of the sealing element and an assembly of arcuate backup members, according to an embodiment.
Figure 7B:
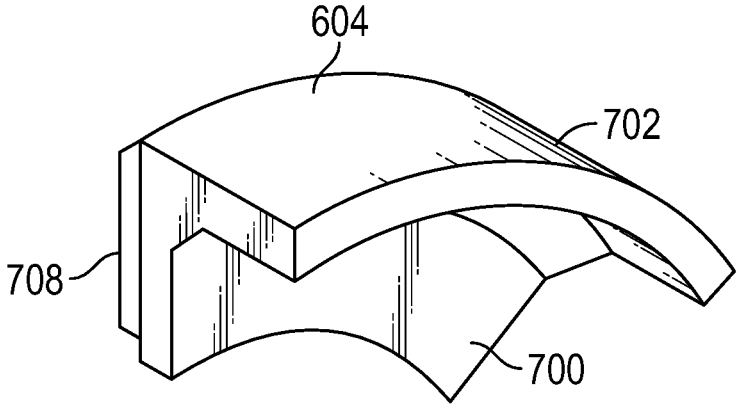
FIG. 7B illustrates a perspective view of one of the arcuate backup members, according to an embodiment.
Figure 7C:
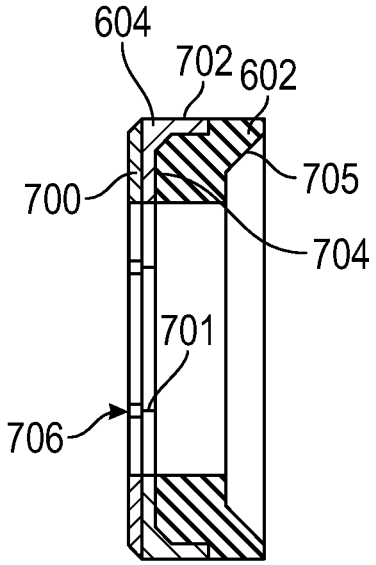
FIG. 7C illustrates a cross-sectional view of the sealing element and backup members, along line 7C-7C of FIG. 7A, according to an embodiment.

FIG. 7A illustrates a perspective view of the modified first sealing element 602 and the plurality of backup members 604, according to an embodiment. FIG. 7B illustrates a perspective view of one of the backup members 604, according to an embodiment. FIG. 7C illustrates a sectional view of the sealing element 602 and the plurality of backup members 604 taking along line 7C-7C in FIG. 7A, according to an embodiment.

The backup members 604 may be circumferentially adjacent to one another, defining interfaces 701 therebetween, and may form a ring, through which the body 102 may be received (see FIG. 6). Further, the backup members 604 may include a face 700 and a lip 702. The face 700 may be positioned along a first end 704 of the first sealing element 602, e.g., between the first end 704 and the cone 606. The lip 702 may be positioned around the first end 122, e.g., on a shoulder formed in the first sealing element 602. A second end 705 of the sealing element 602 may face toward, and may, for example, be received around a portion of, the second sealing element 118 (see FIG. 6).

Alignment recesses 706 may be defined by circumferentially adjacent backup members 604. For example, each of the backup members 604 may define a shoulder 708 at the circumferential extent of the face 700. The alignment recess 706 may thus be defined by the combination of the shoulders 708 of adjacent backup members 604. In other embodiments, the alignment recesses 706 may be defined by notches cut into individual backup members 604.

The backup members 604 may be co-molded with the first sealing element 602. Further, the backup members 604 may not be connected together, apart from their connection with the first sealing element 602. In other embodiments, the backup members 604 may be connected together by a sacrificial structure configured to rupture upon setting, so as to allow the backup members 604 to move freely with the expansion of the first sealing element 602. Accordingly, when the sealing element 602 expands, the backup members 604 may circumferentially separate apart at the interface 701. The backup members 604 may be positioned such that the gaps 113 (see FIG. 6) in the slips assembly 106 are blocked by the backup members 604, i.e., the interfaces 701 between the backup members 604 may be angularly offset or "clocked" with respect to the gaps 113, so as to prevent extrusion of the first sealing element 602 through the gaps 113.

Figure 8:
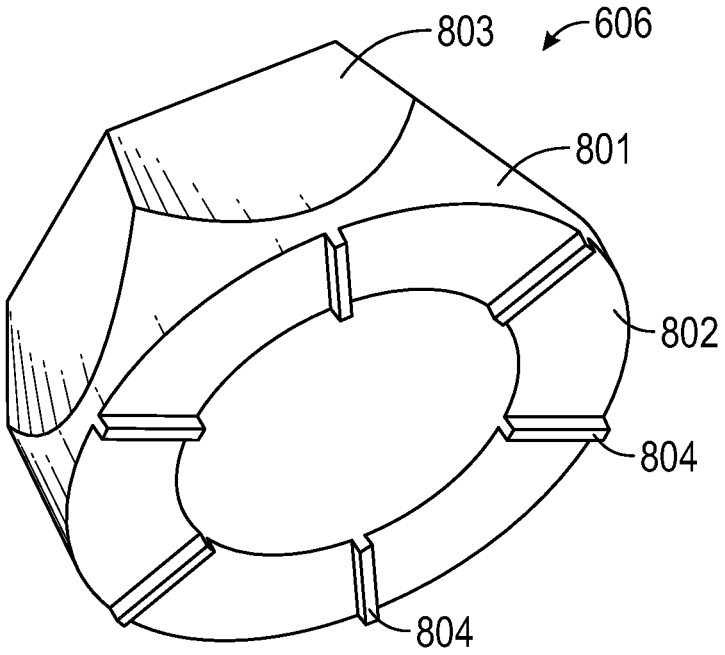
FIG. 8 illustrates a perspective view of a cone, according to an embodiment.

FIG. 8 illustrates a perspective view of the cone 606, according to an embodiment. The cone 606 includes a tapered outer surface 801, along which the slips assembly 106 slides during setting, as previously discussed. More particularly, in this embodiment, the tapered outer surface 801 is complex, including several flattened contours 803, e.g., instead of a smooth conical shape. Each of the flattened contours 803 may receive one of the slips segments 109, and the non-circular geometry may serve to resist angular displacement of the slips segments 109 with respect to the cone 606.

The cone 606 may also include alignment tabs 804, which may extend axially from an end surface 802 of the cone 606. The end surface 802 may be oriented toward the faces 700 of the backup members 604. Further, the alignment tabs 804 may be received into the alignment recesses 706 formed in the plurality of backup members 604. The engagement between the alignment tabs 804 and the alignment recesses 706 may serve to maintain the angular alignment of the backup members 604 with respect to the slips assembly 106, such that the backup members 604 are maintained in position, blocking the gaps 113.

Figure 9:
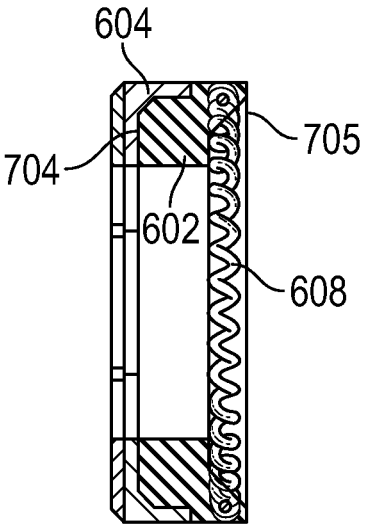
FIG. 9 illustrates a cross-sectional view of the sealing element, the backup members, and an anti-extrusion member, according to an embodiment.

Referring again to FIG. 6, the tool 600 may also include an anti-extrusion member 608, which may be embedded in the first sealing element 602. The anti-extrusion member 608 may be similar to the anti-extrusion member 120 discussed above. However, the anti-extrusion member 608 may be configured for use in combination with the co-molded backup members 604. Referring additionally to FIG. 9, there is shown a more detailed, sectional view of the first sealing element 602 including the backup members 604 and the anti-extrusion member 608.

The anti-extrusion member 608 may be positioned proximal to the second end 705 of the first sealing element 602, which may face the second sealing element 118 (see FIG. 6). The second end 705 may overlap the second sealing element 118, and at least a portion of the first sealing element 602 proximal to the second end 705 may be positioned outward of a portion of the second sealing element 118. The anti-extrusion member 608 may be positioned at, e.g., embedded within or disposed in a groove (see, e.g., FIGS. 10A and 11A) formed in, the portion of the first sealing element 602 that overlaps the second sealing element 118. Accordingly, the anti-extrusion member 120 may serve to prevent extrusion of the second sealing element 118 past the first sealing element 116, and vice versa.

It will be appreciated that aspects of the downhole tools 100, 300, 600 may be combined or separated, as desired, in various embodiments consistent with the present disclosure. For example, the slips ring 301 may be provided along with the backup members 604, as shown in FIG. 6, but, in other embodiments, one of these elements may be provided while the other is omitted. Similarly, the backup members 604 may be provided with or without the anti-extrusion member 608, and the anti-extrusion member 608 may be provided with or without the backup members 604 and/or the slips ring 301.

Figure 10A:
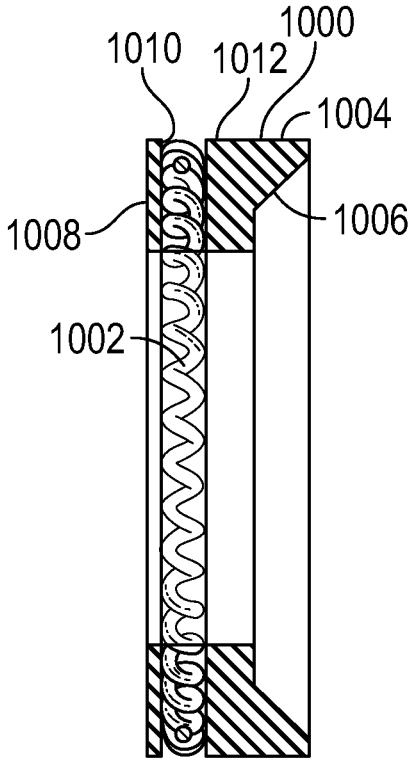
FIG. 10A illustrates a side, cross-sectional views of a sealing element including an anti-extrusion member, according to an embodiment.
Figure 10B:
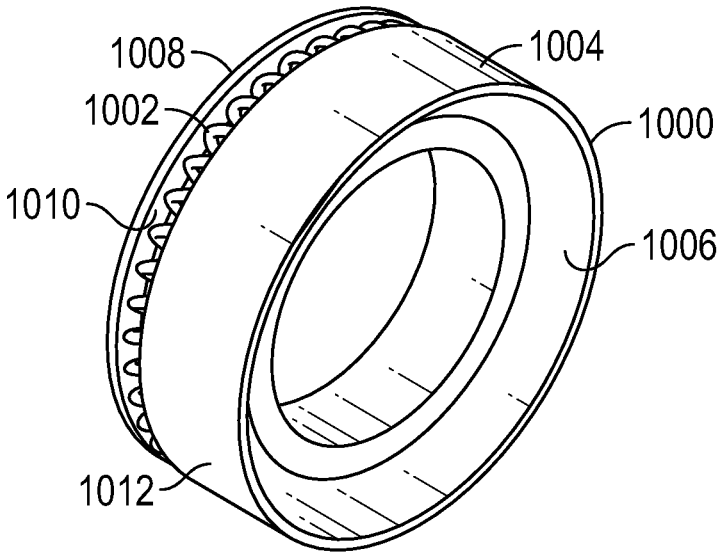
FIG. 10B illustrates a perspective view of the sealing element of FIG. 10A, according to an embodiment.

FIG. 10A illustrates a side, cross-sectional view of a first sealing element 1000 including an anti-extrusion member 1002 positioned therein, according to an embodiment. FIG. 10B illustrates a perspective view of the first sealing element 1000, according to an embodiment. Referring to FIGS. 10A and 10B, as shown, the first sealing element 1000 may include a main body 1004 having a first axial end 1006 and a second axial end 1008. The first axial end 1006 may be configured to be positioned adjacent to another sealing element (e.g., the second sealing element 118, see FIG. 1), and the second axial end 1008 may be oriented toward the slips assembly (e.g., slips assembly 106).

The main body 1004 may define a notch or groove 1010 therein, extending radially inwards from an outer surface 1012 thereof. The groove 1010 may be positioned proximal to, but spaced apart from, the second axial end 1008, resulting in the groove 1010 having walls on three sides (both axial sides and a radial-inward side). The walls of the groove 1010 may be rounded or oriented in other directions than those shown. The anti-extrusion member 1002, which may be a composite spring in a wound (e.g., helical) configuration, may be positioned in the groove 1010. Accordingly, the anti-extrusion member 1002 may be open to the wellbore in the radial outward direction. As such, the anti-extrusion member 1002 may expand with the first sealing element 1000, e.g., without cutting into the material of the main body 1004 radially outward thereof. In an embodiment, the first sealing element 1000 may be used in place of the first sealing element 116 of FIG. 1.

Figure 11A:
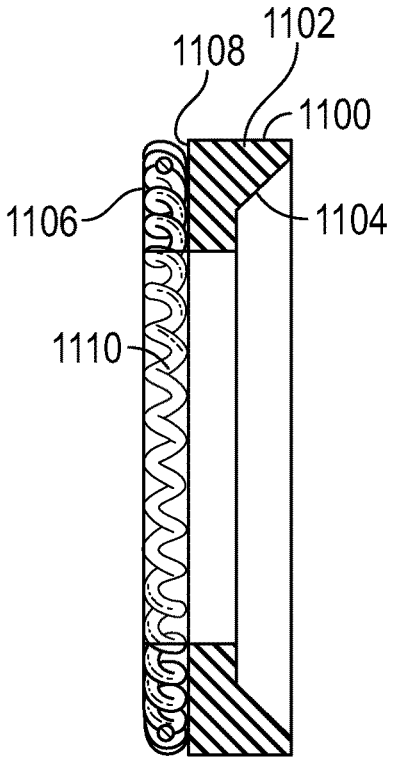
FIG. 11A illustrates a side, cross-sectional view of a sealing element including an anti-extrusion member, according to an embodiment.
Figure 11B:
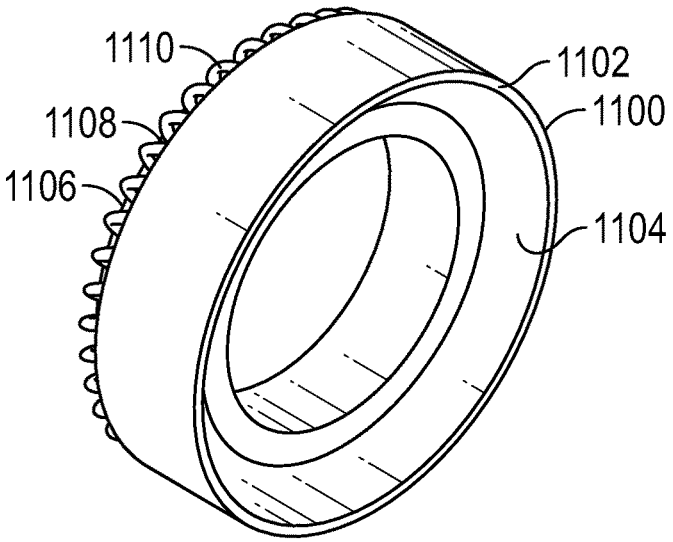
FIG. 11B illustrates a perspective view of the sealing element of FIG. 11A, according to an embodiment.

FIG. 11A illustrates a side, cross-sectional view of another first sealing member 1100, according to an embodiment. FIG. 11B illustrates a perspective view of the first sealing member 1100. The first sealing member 1100 may be generally similar to the first sealing member 1000, and may include a main body 1102 having first and second axial ends 1104, 1106 and defining a notch or groove 1108 extending radially therein. An anti-extrusion member 1110 (e.g., a wound composite spring) may be positioned in the groove 1108, as shown.

The groove 1108 may extend from the second end 1106, such that the groove 1108 forms a shoulder in the main body 1102 and has two walls (a radial-inward wall and an axial wall), while leaving two sides open. As such, when the first sealing member 1100 expands, the anti-extrusion member 1110 may also expand, and may not cut into the material of the main body 1102 on the open sides. In an embodiment, the first sealing element 1100 may be used in place of the first sealing element 116 in FIG. 1.

Figure 12:
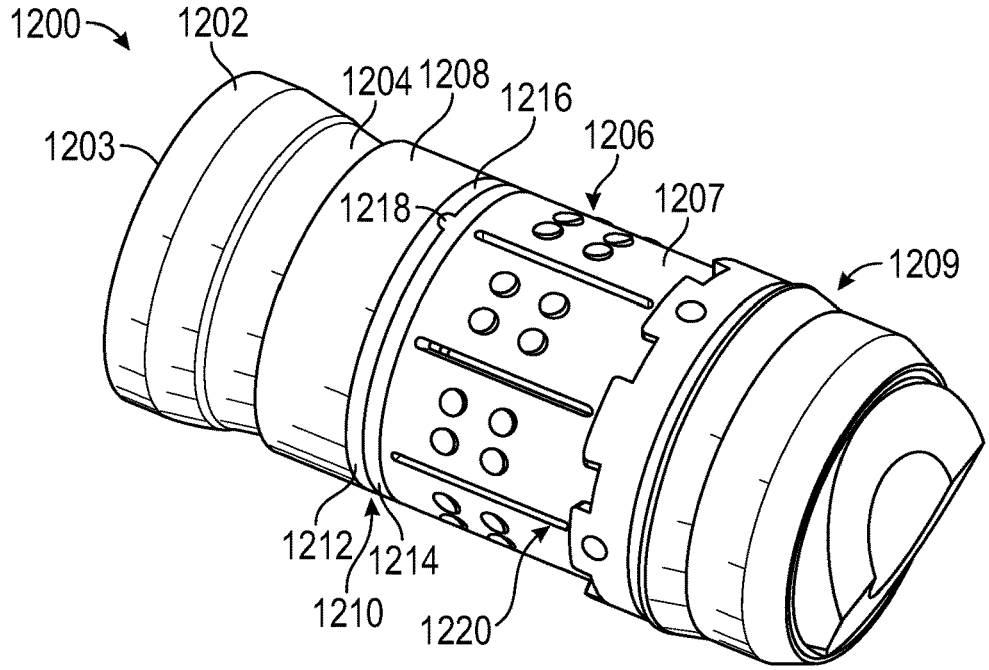
FIG. 12 illustrates a perspective view of another downhole tool in a run-in configuration, according to an embodiment.

FIG. 12 illustrates a perspective view of another downhole tool 1200 in a run-in configuration, according to an embodiment. The downhole tool 1200 generally includes a cone 1202 having a base 1203 and a tapered surface 1204 that extends axially from the base 1203. In particular, the tapered surface 1204 may extend radially inward as proceeding away from the base 1203. In some embodiments, the tool 1200 may omit an inner mandrel or body. In other embodiments, an inner mandrel or body such as that described above, may be provided.

The tool 1200 includes a slips assembly 1207 including a plurality of slips 1206 that are connected together and partially circumferentially spaced apart by gaps 1220, so as to facilitate breaking the slips 1206 apart when the tool 1200 is set in a wellbore. The plurality of slips 1206 may be positioned adjacent to at least a portion of the cone 1202. For example, the slips 1206 may be positioned at least partially around the tapered surface 1204 (thereby being axially adjacent to the rest of the cone 1202), or may not, at least initially, be around the tapered surface 1204. Further, the tool 1200 includes a sealing element 1208 positioned at least partially around the tapered surface 1204 of the cone 1202. The tool 1200 may also include a lower assembly 1209 that may include a shoe, as shown, and/or any other suitable components.

A backup member 1210 is positioned axially intermediate of the slips 1206 and the sealing element 1208. The backup member 1210 may include two or more slips rings (two shown: 1212, 1214). The slips rings 1212, 1214 may be axially adjacent to one another, so as to form a stack of rings 1212, 1214 (along with any other rings that may be provided).

The slips rings 1212, 1214 may include a notch 1216 and an alignment tab 1218, respectively. The notch 1216 of the slips ring 1212 may be configured to snugly receive the tab 1218 of the adjacent slips ring 1214. The slips ring 1214 may also include a notch, which may be circumferentially offset from the tab 1218 thereof, and thus is not visible in this view. Optionally, the slips ring 1212 may also include a tab, e.g., receivable into the notch of the slips ring 1214. In some embodiments, each of the slips rings 1212, 1214 may include two or more tabs and/or two or more notches. The engagement between the notch 1216 and the alignment tab 1218 may serve to align the rotational positions of the rings 1212, 1214 relative to one another, and thus may be an example of an "alignment feature." It will be appreciated that a variety of structures may be capable of providing such an alignment feature that prevents the rings 1212, 1214 from rotating with respect to one another.

Figure 13:
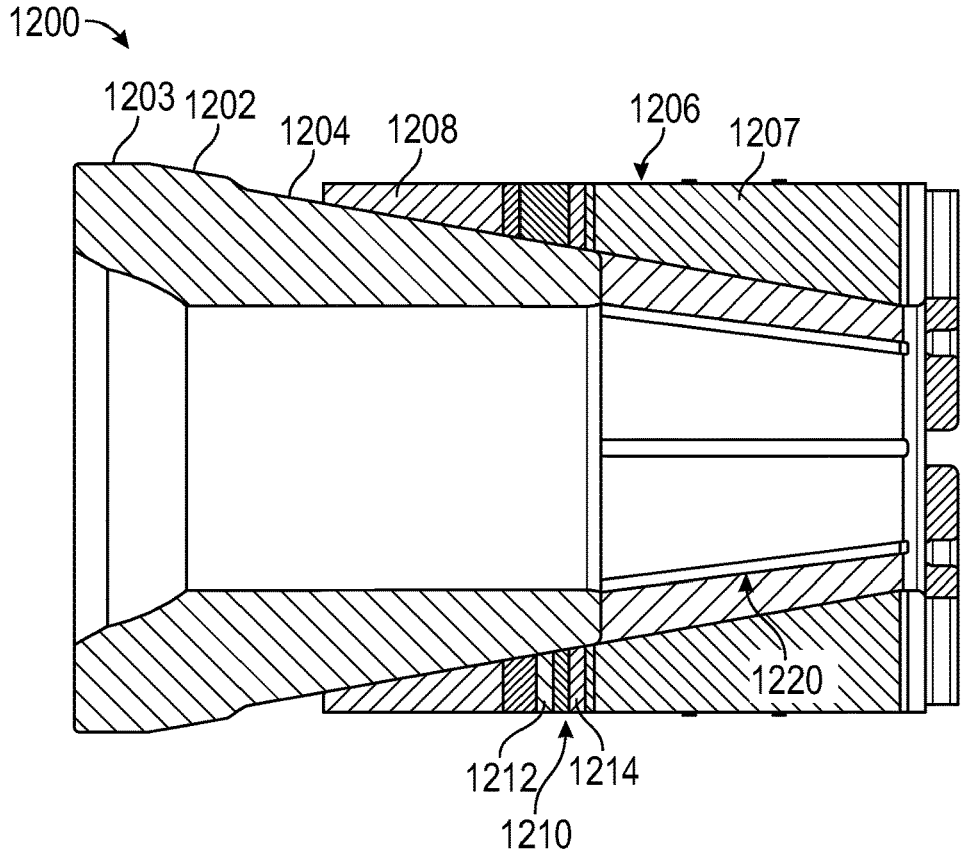
FIG. 13 illustrates a side, cross-sectional view of the downhole tool of FIG. 12 in the run-in configuration, according to an embodiment.

FIG. 13 illustrates a partial, cross-sectional view of the tool 1200 in a run-in configuration, according to an embodiment. As shown, the tapered surface 1204 of the cone 1202 extends through an inner diameter surface of the sealing element 1208, the backup member 1210, and/or the slips 1206.

Figure 14:
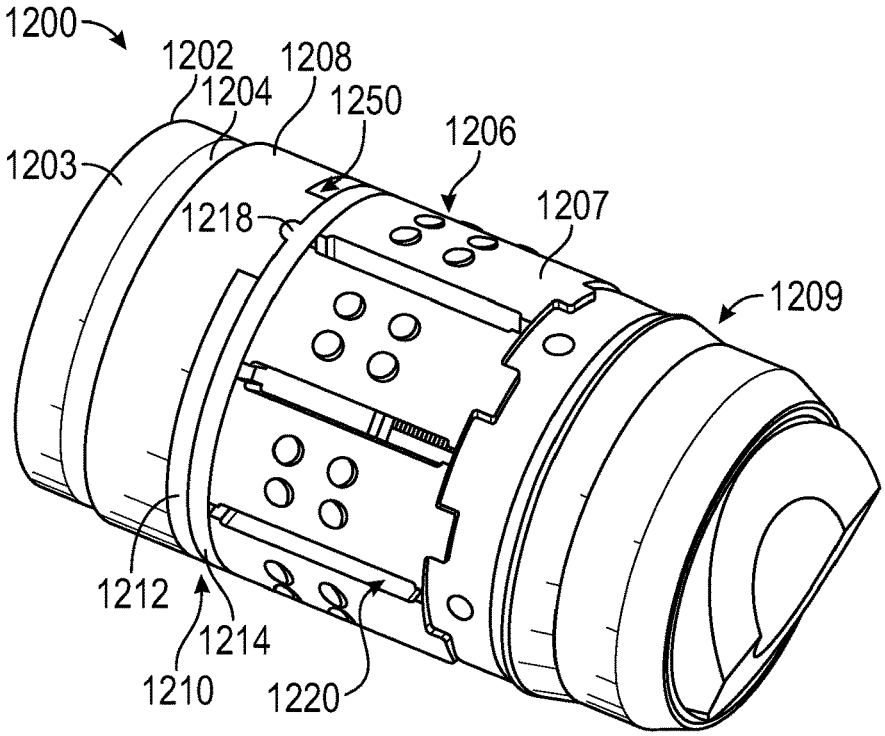
FIG. 14 illustrates a perspective view of the downhole tool of FIG. 12 in a set configuration, according to an embodiment.

Accordingly, when the cone 1202 is driven axially towards the slips 1206 (e.g., to the right, as shown in FIGS. 12 and 13), the tapered surface 1204 wedges progressively farther into the sealing element 1208, slips 1206, and backup member 1210, pushing these components radially outward. Eventually, the tool 1200 reaches a set configuration, where the tool 1200 is configured to be positionally fixed with respect to a surrounding tubular (e.g., a casing, liner, or the wellbore wall) and sealed therewith. FIG. 14 illustrates an example of such a set configuration of the tool 1200.

In this configuration, the sealing element 1208 is radially and circumferentially stretched to expand, while the more rigid slips 1206 break apart and expand. The rings 1212, 1214 of the backup member 1210 are also driven outwards by riding up on the tapered surface 1204 and break apart, e.g., the ring 1212 may fracture at the notch 1216, resulting in a gap 1250 forming between two circumferential ends of the ring 1212. As noted above, the notch of the ring 1214 is offset from the tab 1218 and the notch 1216, and thus a corresponding gap may form, offset from the gap 1250, which is not visible in this view.

Thus, the rings 1212, 1214 may, together, form a barrier between the sealing element 1208 and the slips 1206. For example, the rings 1212, 1214 may be angularly offset (out of phase) C-rings, such that the body of one of the rings 1214 blocks the gap 1250 in the other ring 1212 formed by expanding the rings 1212, 1214. As such, the sealing element 1208 may be prevented from extruding, as it is blocked on its radial inside by the tapered surface 1204 of the cone 1202, on one axial side by the base 1203 of the cone 1202, on its opposite axial side by the backup member 1210, and by the surrounding tubular on its radial outside.

Figure 15A:
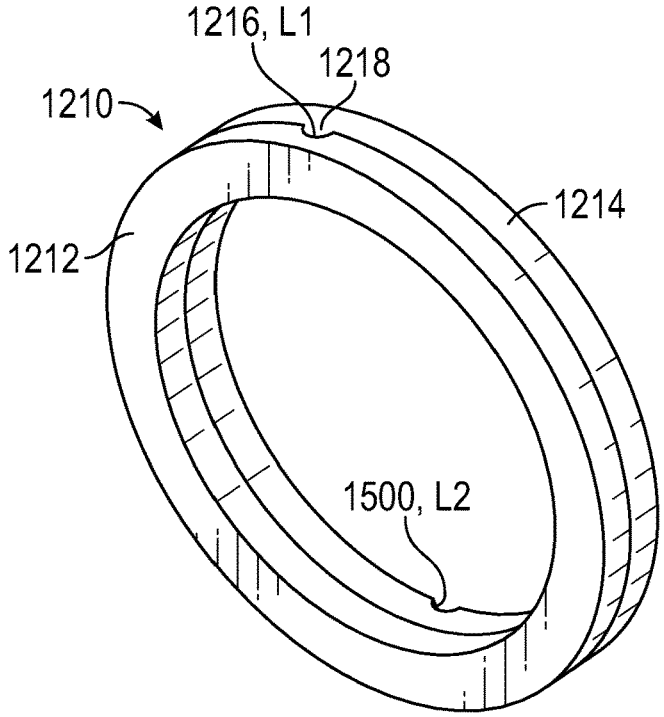
FIG. 15A illustrates a perspective view of a backup member of the tool of FIG. 12A in the run-in configuration, according to an embodiment.
Figure 15B:
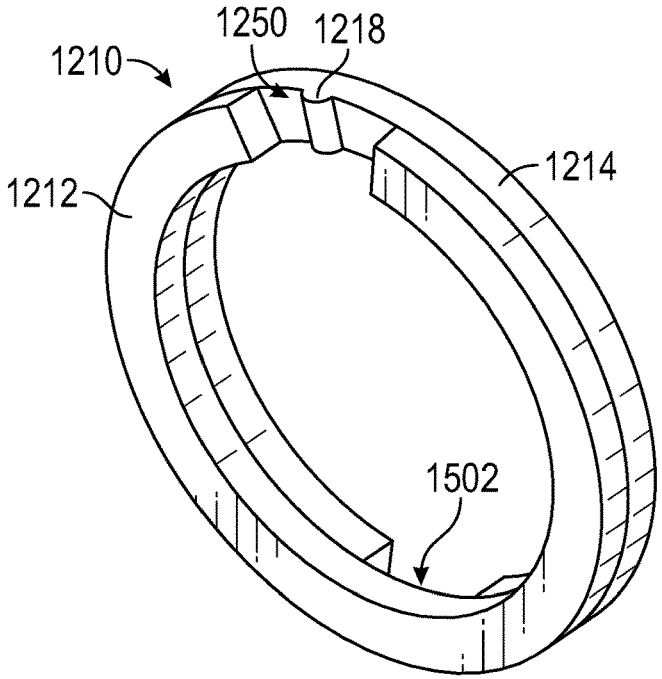
FIG. 15B illustrates a perspective view of the backup member of FIG. 14B, but in a set configuration, according to an embodiment.

FIGS. 15A and 15B illustrate perspective views of the backup member 1210 in the run-in and set configurations, respectively. As shown, the backup member 1210 includes the rings 1212, 1214. The ring 1212 includes the notch 1216, and the ring 1214 includes the tab 1218. In addition, as mentioned above, the ring 1214 includes a second notch 1500 that is offset from the notch 1216 by approximately 180 degrees around the ring 1214. In other embodiments, additional or fewer such notches may be provided, and may be positioned at any suitable angular interval. The notches 1216 and 1500 may serve as preferential breaking locations L1, L2 for the rings 1212, 1214 as they expand. The breaking locations L1, L2 may be offset circumferentially from one another, e.g., about 180 degrees. Further, the ring 1212 and/or the ring 1214 may include a second tab positionable within a notch of the ring 1214, e.g., offset by approximately 180 degrees from the first notch 1216.

Accordingly, turning to FIG. 15B, when the backup member 1210 is expanded, the rings 1212, 1214 may rupture at the notches 1216, 1500, resulting in the gap 1250 in the ring 1212 and a gap 1502 in the ring 1214. Since the notches 1216, 1500 (breaking locations L1, L2) are offset circumferentially, the gaps 1250, 1502 may thus also be offset circumferentially from one another, such that the backup member 1210 provides a continuous barrier in the axial direction that prevents extrusion of the sealing element 1208 (FIG. 12).

Figure 16:
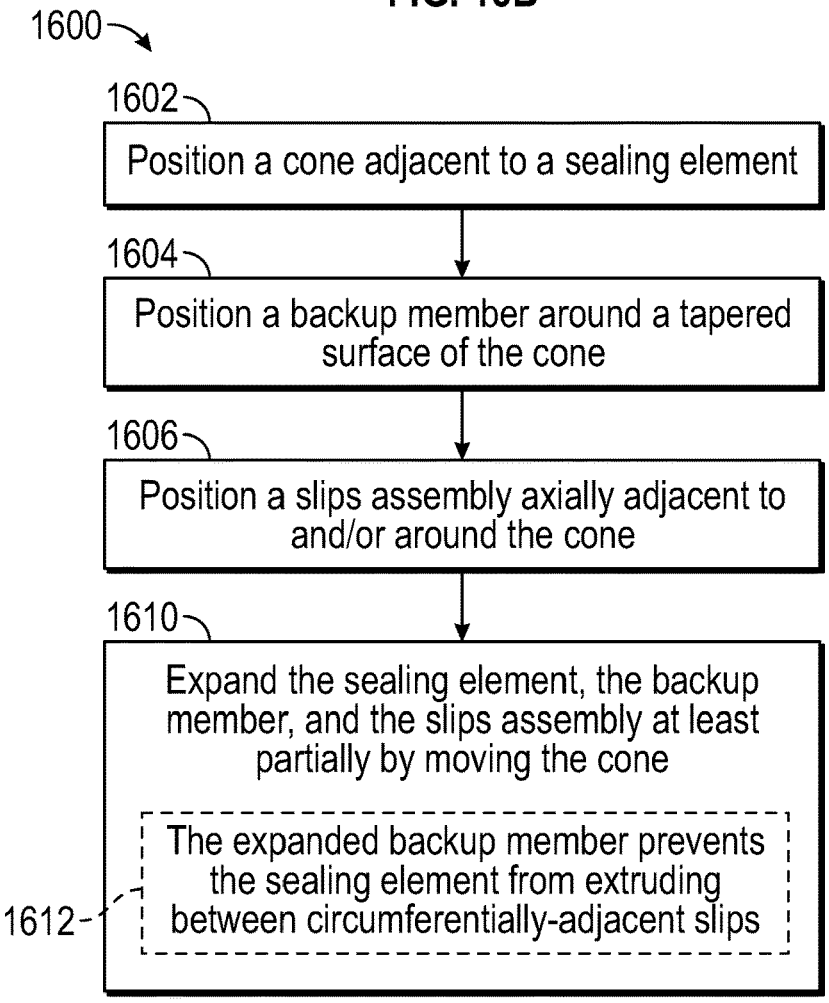
FIG. 16 illustrates a flowchart of a method for packing a wellbore, according to an embodiment.

FIG. 16 illustrates a flowchart of a method 1600 for preventing extrusion of a sealing element (e.g., the sealing element 1208) between circumferentially-adjacent slips of the plurality of slips 1206. For the sake of convenience, an embodiment of the present method 1600 will be described with reference to the embodiment of FIG. 12, showing the tool 1200 (where appropriate, however, the tool 300 is also referred to); however, it will be appreciated that this is merely an example, and some embodiments of the method 1600 may employ other structures.

The method 1600 may include positioning a cone 1202 axially adjacent to a sealing element 1208 of a downhole tool, as at 1602. The method 1600 may also include positioning a backup member 1210 around a tapered surface 1204 of the cone 1202, as at 1604. The method 1600 may further include positioning a slips assembly 1207 including a plurality of slips 1206 axially adjacent to and/or around the cone 1202, such that the backup member 1210 is axially between the sealing element and the slips assembly, as at 1606. In some embodiments, such as in FIG. 3, the cone 110B may be axially between the sealing element 116 and the slips assembly 109. In other embodiment, such as in FIG. 12, the sealing element 1208 may be between the cone 1202 and the slips assembly 1207.

The method 1600 may also include expanding the sealing element 1208, the backup member 1210, and the slips assembly 1207, at least partially by moving the cone 1202 relative to the backup member 1210 and the slips assembly 1207, as at 1608. The backup member 1210 is configured to prevent the sealing element 1208 from extruding through gaps 1220 defined between circumferentially-adjacent slips 1206 of the slips assembly 1207. The expanded backup member 1210, still positioned around the cone 1202, prevents the sealing element from extruding between the circumferentially-adjacent slips 1206, e.g., through the gaps 1220.

In an embodiment, the sealing element 1208 may be is positioned at least partially around the tapered surface 1204 of the cone 1202. Thus, expanding the sealing element at 1608 may include moving the cone 1202 with respect to the sealing element 1208. Expanding the backup member 1210 at 1608 may include breaking a first ring 1212 of the backup member 1210 at a first circumferential location L1 and breaking a second ring 1214 of the backup member at a second location L2, the first location L1 being circumferentially offset from the second location L2.

In an alternative embodiment (e.g., FIG. 3), positioning the backup member (e.g., slips ring 301) at 1604 may include positioning tabs 304 of the backup member into the gaps 113 between the circumferentially-adjacent slips 109.

Referring to FIGS. 3 and 4, expanding the backup member at 1608 may include breaking the backup member into a plurality of arcuate segments 404. At least one of the plurality of arcuate segments 404 includes a tab 304 received into one of the gaps 113 between the circumferentially-adjacent slips 109 prior to expanding the slips 109.

Further, an axial face of the cone 110B may bears on an axial face of the sealing element 116. Accordingly, expanding the sealing element 116 at 1608 may include applying an axial load to the sealing element 116 via the cone 110B, to axially compress and radially expand the sealing element 116.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A downhole tool, comprising:

a sealing element configured to expand radially outwards to form a seal with a surrounding tubular;

a cone defining a tapered surface;

a slips assembly comprising a plurality of slips, wherein the slips assembly is receivable at least partially around the cone, such that moving the cone in an axial direction with respect to the slips assembly causes the plurality of slips to separate circumferentially apart; and a backup member positionable at least partially around the tapered surface of the cone and positioned adjacent to the slips assembly, wherein the backup member is configured to break as the cone is moved toward the plurality of slips, to prevent the sealing element from extruding between circumferentially-adjacent slips of the plurality of slips.

2. The tool of claim 1, wherein the backup member comprises a plurality of rings positioned axially adjacent to one another.

3. The tool of claim 2, wherein a first ring of the plurality of rings comprises a first notch, and a second ring of the plurality of rings comprises a tab and a second notch, the tab being received into the first notch, and the first and second notches being circumferentially offset from one another.

4. The tool of claim 3, wherein:

the first ring is configured to break at the first notch, such that a first gap in the first ring is formed when the first ring is expanded; and the second ring is configured to break at the second notch, such that a second gap in the second ring is formed when the second ring is expanded, the first and second gaps being circumferentially offset from one another.

5. The tool of claim 2, wherein the plurality of rings are positioned axially between the sealing element and the slips assembly, and wherein the sealing element is positioned at least partially around the tapered surface of the cone.

6. The tool of claim 1, wherein the backup member comprises a slips ring having a plurality of tabs, wherein each of the tabs is receivable into a plurality of gaps defined between circumferentially-adjacent slips of the plurality of slips.

7. The tool of claim 6, wherein the backup member comprises a plurality of notches, wherein each of the notches is positioned circumferentially between two of the tabs.

8. The tool of claim 7, wherein the backup member is configured to fracture at the plurality of notches, such that the backup member, when expanded, comprises a plurality of arcuate segments, wherein at least two of the arcuate segments each include at least one of the tabs.

9. The tool of claim 6, wherein the cone is positioned axially between the sealing element and the slips assembly.

10. A method, comprising:

positioning a cone axially adjacent to a sealing element of a downhole tool;

positioning a backup member around a tapered surface of the cone;

positioning a slips assembly comprising a plurality of slips axially adjacent to at least a portion of the cone, such that the backup member is axially between the sealing element and the slips assembly, wherein the backup member is positioned adjacent to the slips assembly; and expanding the sealing element, the backup member, and the slips assembly, at least partially by moving the cone relative to the backup member and the slips assembly, wherein the backup member is configured to prevent the sealing element from extruding through gaps defined between circumferentially-adjacent slips of the plurality of slips of the slips assembly.

11. The method of claim 10, wherein expanding the backup member comprises breaking a first ring of the backup member at a first circumferential location and breaking a second ring of the backup member at a second location, the first location being circumferentially offset from the second location.

12. The method of claim 10, wherein positioning the backup member comprises positioning tabs of the backup member into the gaps between the circumferentially-adjacent slips.

13. The method of claim 12, wherein expanding the backup member comprises breaking the backup member into a plurality of arcuate segments, wherein at least one of the plurality of arcuate segments comprises a tab received into one of the gaps between the circumferentially-adjacent slips prior to expanding the slips assembly.

14. The method of claim 10, wherein an axial face of the cone bears on an axial face of the sealing element, and wherein expanding the sealing element comprises applying an axial load to the sealing element via the cone, to axially compress and radially expand the sealing element.

15. A method, comprising:

positioning a cone axially adjacent to a sealing element of a downhole tool;

positioning a backup member around a tapered surface of the cone;

positioning a slips assembly comprising a plurality of slips axially adjacent to at least a portion of the cone, such that the backup member is axially between the sealing element and the slips assembly; and expanding the sealing element, the backup member, and the slips assembly, at least partially by moving the cone relative to the backup member and the slips assembly, wherein the backup member is configured to prevent the sealing element from extruding through gaps defined between circumferentially-adjacent slips of the plurality of slips of the slips assembly, wherein the sealing element is positioned at least partially around the tapered surface of the cone, and wherein expanding the sealing element comprises moving the cone with respect to the sealing element.

16. A downhole tool, comprising:

a sealing element that is expandable radially outwards to form a seal with a surrounding tubular;

a cone defining a tapered surface;

a plurality of slips receivable at least partially around the cone, wherein the plurality of slips are configured to separate circumferentially apart by moving the cone in an axial direction toward the plurality of slips; and at least one slips ring positioned at least partially around the tapered surface of the cone and axially between the sealing element and the plurality of slips, wherein the at least one slips ring is positioned adjacent to the plurality of slips, wherein the at least one slips ring is configured to break as the cone is moved toward the plurality of slips, and wherein the at least one slips ring is configured to prevent the sealing element from extruding between circumferentially-adjacent slips of the plurality of slips.

17. The tool of claim 16, wherein the at least one slips ring comprises a plurality of tabs and a plurality of notches, wherein respective notches of the plurality of notches are positioned circumferentially between two of the plurality of tabs, and wherein the plurality of tabs are received into gaps formed between the circumferentially-adjacent slips.

18. The tool of claim 17, wherein the at least one slips ring is configured to break apart at the plurality of notches as the cone is moved toward the plurality of slips, so as to form a plurality of arcuate sections, each of the plurality of arcuate sections including one of the plurality of tabs.

19. The tool of claim 17, wherein the at least one slips ring comprises a first ring and a second ring, the first and second rings being axially adjacent, the first ring being configured to break at a first location, and the second ring being configured to break at a second location, the first and second locations being circumferentially offset.

20. The tool of claim 19, wherein the first ring, the second ring, or both comprise an alignment feature configured to maintain the offset between the first and second locations.

21. The tool of claim 20, wherein the alignment feature comprises a tab of the first ring and a notch of the second ring, the tab being received into the notch, and the second ring being configured to break at the notch.

* * * * *